US006638040B2

(12) United States Patent
Wang et al.

(10) Patent No.: US 6,638,040 B2
(45) Date of Patent: Oct. 28, 2003

(54) DRY VACUUM PUMP

(75) Inventors: Chih-Cheng Wang, Hsin Chu Hsien (TW); Jenn Chen Tang, Hsin Chu Hsien (TW); Cheng Chou Shieh, Hsin Chu Hsien (TW); Weng-Shih Cang, Hsin Chu Hsien (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 0 days.

(21) Appl. No.: 10/029,837

(22) Filed: Dec. 31, 2001

(65) Prior Publication Data

US 2003/0124011 A1 Jul. 3, 2003

(51) Int. Cl.[7] ..... F04C 18/00

(52) U.S. Cl. ..... 418/3; 418/5; 418/55.1; 418/266; 418/152; 418/13; 417/201

(58) Field of Search ..... 418/3, 5, 55.1, 418/266, 13, 152; 417/201, 205

(56) References Cited

U.S. PATENT DOCUMENTS 5,947,694 A * 9/1999 Hablanian ..... 417/201

FOREIGN PATENT DOCUMENTS

| | | | | |
|---|---|---|---|---|
| DE | 3637229 A1 | * | 6/1997 | ..... F04C/11/00 |
| JP | 62-243982 | * | 10/1987 | ..... 418/3 |
| JP | 04-109089 | * | 4/1992 | ..... 418/3 |

* cited by examiner

*Primary Examiner*—Thomas Denion
*Assistant Examiner*—Theresa Trieu
(74) *Attorney, Agent, or Firm*—Bacon & Thomas PLLC

(57) ABSTRACT

A dry vacuum pump comprises a scroll-type vacuum pump and a rotary-vane vacuum pump, wherein the rotary-vane vacuum pump is mounted on the side of an inlet, whereas the scroll-type vacuum pump is mounted on the side of an outlet, and then a compound-type dry vacuum pump is formed by connecting and integrating the rotary-vane vacuum pump and the scroll-type vacuum pump, having the advantages of high compression ratio, high vacuuming speed, low production cost and simplified structure, thus improving the working effectiveness and quality of pumps accordingly.

6 Claims, 3 Drawing Sheets

DRY VACUUM PUMP

BACKGROUND OF THE INVENTION

1. Field of the Invention

The present invention relates to a dry vacuum pump, and more particularly, to a dry vacuum pump that combines both the advantage of high compression ratio of the scroll-type vacuum pump, and the advantage of high exhausting speed of the rotary-vane vacuum pump, with simple structure, lower production cost and higher working effectiveness and quality.

2. Description of the Prior Art

The conventional rotary-vane pump 10, shown in FIG. 2, comprises a rotor 12, a pair of rotary vanes 13 and a stator chamber 15, wherein, a pair of vanes made of graphite are mounted on the rotor 12 through grooves thereon; in the interior of the stator chamber 15 a round-shaped rotating space 19 is formed and the rotor 12 is eccentrically positioned therein, with the rotor 12 and the pair of vanes 13 pressed by spring 18 coming into contact with the stator chamber wall 14 of the stator chamber 15. An inlet 11 and an outlet 17, both connecting the rotating space 19, are mounted on the stator chamber 15, with the opening and closing of the outlet 17 being controlled by an outlet valve 16.

Please further refer to FIG. 2 in accordance with FIG. 3 and FIG. 4. The rotor 12 is directly driven by motor to circularly rotate within the rotating space 19, during which the two vanes 13 begin to slide in the grooves of the rotor 12, with the ends of both vanes keeping contact with the stator chamber wall 14; since the two vanes are made of graphite, it is of no need to use vacuum pump oil to lubricate. Thus, by the movement of the rotor 12 and the vanes 13, the goals of introducing air through the inlet 11 and discharging air through the outlet 17 are to be achieved.

The advantage of such rotary-vane vacuum pump is the excellent exhausting speed, yet it has poor range of vacuum compression ratio.

The conventional scroll-type vacuum pump 20, shown in FIG. 5, comprises two scrolls 21 and 22, wherein, one scroll is a fixed scroll 21 that is a counter-clockwise helicoid, and the other scroll is an orbiting scroll 22 that is a clockwise helicoid. These two scrolls define a space (the air-introducing space 42, which is to be described later), and the orbiting scroll 22, being mounted on the eccentric of the motor driving crank, is driven to revolve but not self-revolving due to the restriction of the anti-self-revolving mechanism; such revolving motion is to form an orbiting motion, by which the orbiting scroll 22 is to rotate clockwise, thus air in the air-introducing space is to be compressed, and then air compressed is to be discharged through the central outlet hole 23.

The advantage of such scroll-type vacuum pump 20 is the high compression ratio, but since its motioning displacement is small, causing poor exhausting speed, it cannot be used for workload that requires higher exhausting speed, but only for lighter workload. The motor power can be expanded for such scroll-type vacuum pump 20 to increase the discharging (exhausting) speed, but the problem of overheating resulted therefrom shall acquire larger capacity of the cooling system.

SUMMARY OF THE INVENTION

The main object of the present invention is to provide a dry vacuum pump that combines the scroll-type vacuum pump and the rotary-vane vacuum pump, thus having the advantage of high compression ratio from the scroll-type vacuum pump, and the advantage of high exhausting speed from the rotary-vane vacuum pump, with simple structure, lower production cost and higher working effectiveness and quality.

The dry vacuum pump that achieves the aforementioned goals comprises a housing, with an inlet and an outlet; a rotary-vane vacuum pump, mounted inside the housing, including the rotor, a pair of rotary vanes and the stator chamber; a scroll-type vacuum pump, mounted inside the housing, including a fixed scroll and an orbiting scroll, and a motor-driven crank, used for driving the orbiting scroll of the scroll-type vacuum pump and the rotor of the rotary-vane vacuum pump. The rotary-vane vacuum pump is mounted on the side of the inlet, whereas the scroll-type vacuum pump is mounted on the side of the outlet, thus forming a conduit to connect both the rotary-vane vacuum pump and the scroll-type vacuum pump, for discharging and exhausting air, whereby air is introduced from the rotary-vane pump and discharged to the air-introducing space of the scroll-type vacuum pump, and then air is exhausted by the scroll-type vacuum pump.

The two vanes are mounted in the grooves of the rotor.

The vanes are made of graphite.

In the interior of the stator chamber a round-shaped rotating space is formed and the rotor is eccentrically positioned therein.

The rotor and the two vanes pressed by spring are to come into contact with the stator chamber wall of the stator chamber.

The inlet of the housing is connected to the rotating space of the stator chamber.

The outlet of the stator chamber is connected, via the channel of the housing, to the air-introducing space of the scroll-type vacuum pump, with the opening and closing of the outlet being controlled by an outlet valve.

The outlet of the housing is connected to the air-introducing space.

The rotary-vane vacuum pump and the scroll-type vacuum pump are adjacently mounted (e.g., by way of left-and-right juxtaposition) inside the housing; in addition, the housing is mounted with a right-end plate, and the ball-type anti-self-revolving mechanism is mounted between the right-end plate and the orbiting scroll of the scroll-type vacuum pump. Also a left-end plate is mounted in the housing located on the left side of the rotary-vane vacuum pump.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

Figure 1:
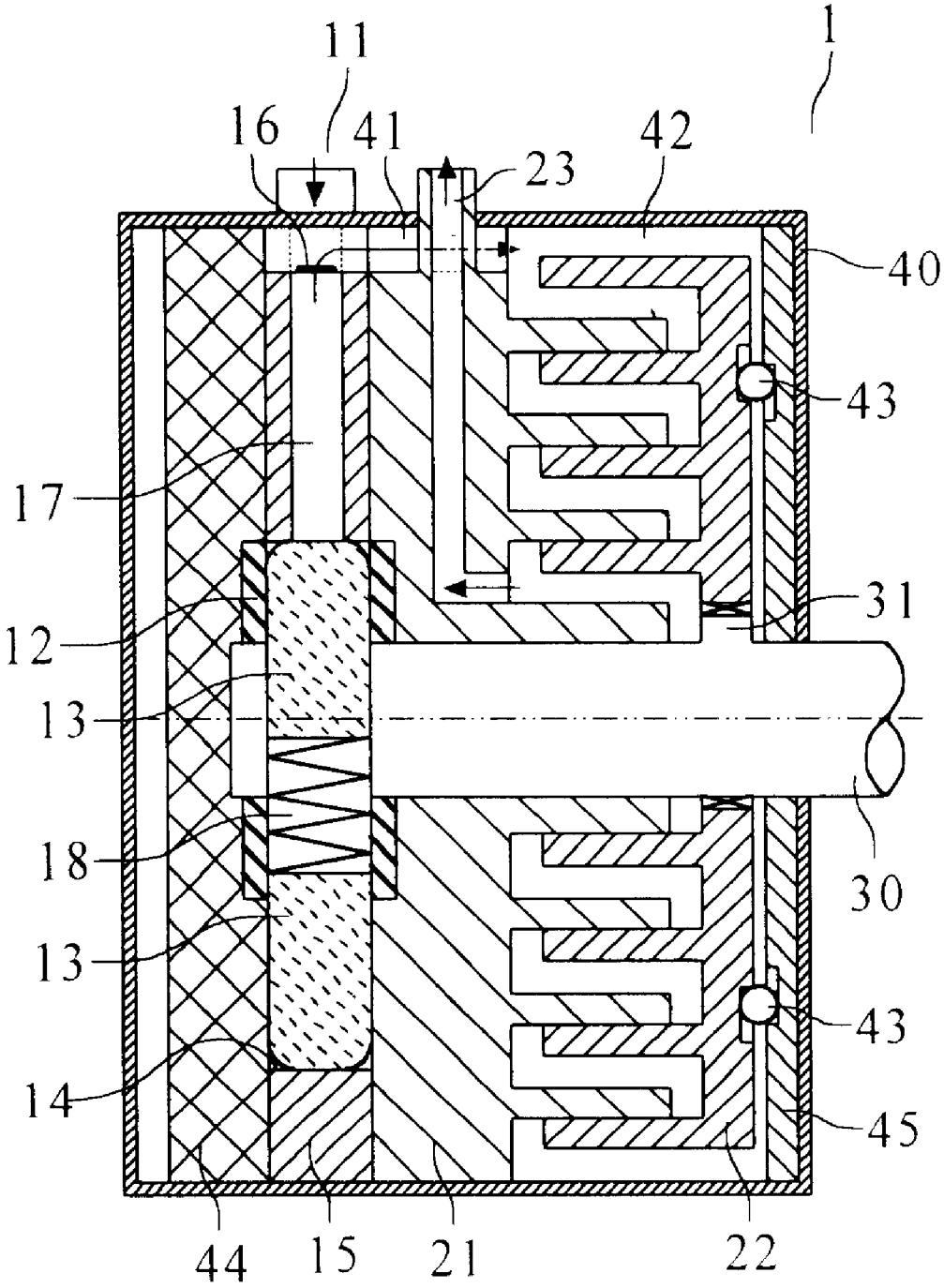
FIG. 1 shows a sectional structural view from the standpoint of the X—X line in FIG. 2 to FIG. 5 of the dry vacuum pump of the present invention.
Figure 2:
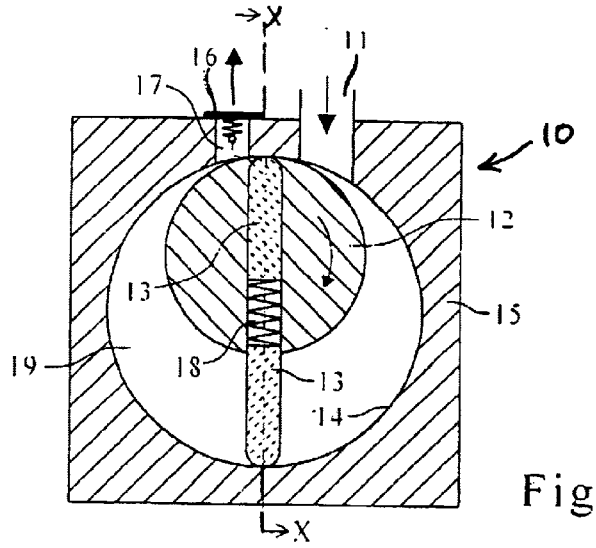
FIG. 2 shows a structural view of the conventional rotary-vane vacuum pump applied in the dry vacuum pump of the present invention.
Figure 3:
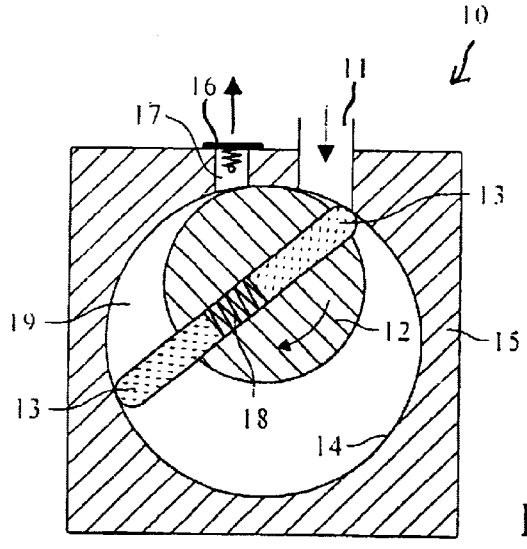
FIG. 3 shows an example of the rotating motion of the rotor in a conventional rotary-vane vacuum pump.
Figure 4:
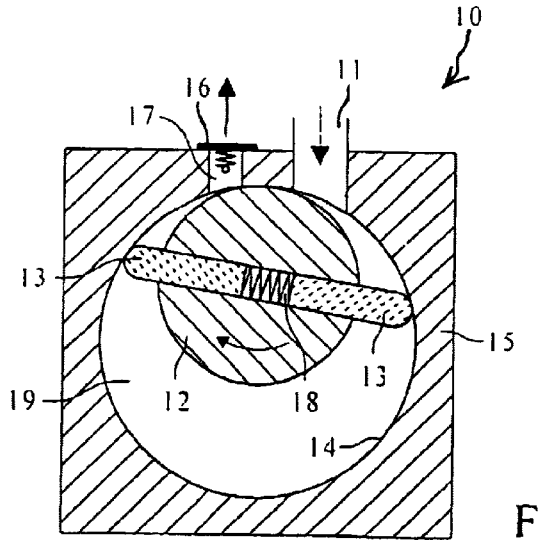
FIG. 4 shows another example of the rotating motion of the rotor in a conventional rotary-vane vacuum pump.
Figure 5:
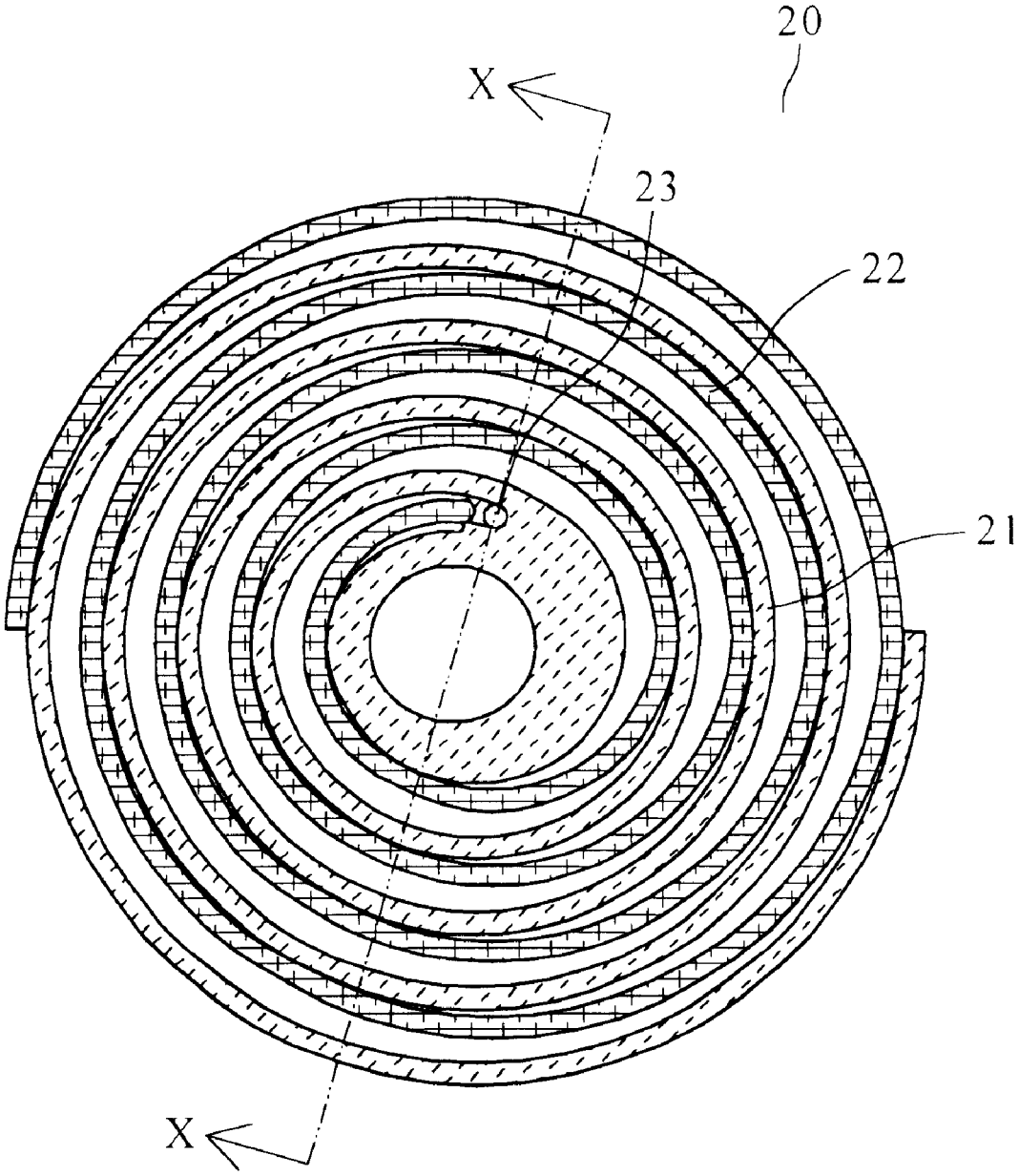
FIG. 5 shows a structural view of the conventional scroll-type vacuum pump applied in the dry vacuum pump of the present invention.

As shown in FIG. 1, the dry vacuum pump 1 of the present invention comprises: a housing 40, a rotary-vane vacuum pump 10 (refer to FIG. 2), a scroll-type vacuum pump 20 (refer to FIG. 5) and a motor-driven crank 30; wherein the housing 40 includes an inlet 11 and an outlet 23; the rotary-vane vacuum pump 10 includes rotor 12, a pair of vanes 13 and a stator chamber 15; the rotary-vane vacuum pump 10 is mounted on the left side of the interior of the housing 14; the scroll-type vacuum pump 20, comprising a fixed scroll 21 and an orbiting scroll 22, is mounted on the right side of the interior of the housing 14, and is adjacently connected to the rotary-vane vacuum pump 10; the crank 30, driven by motor (not shown in figures), is utilized, via an eccentric 31, to drive the orbiting scroll 22 of the scroll-type vacuum pump 20, and the rotor 12 of the rotary-vane vacuum pump 10.

The two vanes 13, made of graphite, is mounted in the grooves of the rotor 12 of the rotary-vane vacuum pump 10 (refer to FIG. 2), and in the interior of the stator chamber 15 a round-shaped rotating space 19 is formed and the rotor 12 is eccentrically positioned therein, thus the rotor 12 and the two vanes 13 pressed by spring 18 are to come into contact with the stator chamber wall 14 of the stator chamber 15.

The scroll-type vacuum pump 20 (refer to FIG. 5) comprises a fixed scroll 21 that is a counter-clockwise helicoid, and an orbiting scroll 22 that is a clockwise helicoid. These two scrolls define an air-introducing space 42.

The housing is further mounted with a right-end plate 45, and a ball-type anti-self-revolving mechanism 43 is mounted between the right-end plate 45 and the orbiting scroll 22 of the scroll-type vacuum pump 20. Also a left-end plate is further mounted in the housing 40 located on the left side of the rotary-vane vacuum pump 10.

The inlet 11 of the housing 40 is connected to the rotating space 19 that is connected to the outlet 17 having outlet valve 16; the outlet 17 is then connected to the air-introducing space 42, which is connected to the outlet 23 of the housing 40, thus forming an air-introducing/discharging conduit to connect both the rotary-vane vacuum pump 10 and the scroll-type vacuum pump 20, for discharging and exhausting air, whereby air is introduced from the rotary-vane vacuum pump 10 and discharged to the air-introducing space 42 of the scroll-type vacuum pump 20, and then air is exhausted by the scroll-type vacuum pump 20.

When motor is running, the crank 30 simultaneously drives both the rotary-vane vacuum pump 10 and the scroll-type vacuum pump 20. On one hand, the rotor 12 of the rotary-vane vacuum pump 10 is driven by the crank 30 to circularly rotate in the rotating space 19, during which the two vanes 13 begin to slide in the grooves of the rotor 12, with the ends of both vanes keeping contact with the stator chamber wall 14. By the movement of the rotor 12 and the vanes 13, the goals of introducing air through the inlet 11 of the housing 40 and discharging air through the outlet 17 of the housing 40 are to be achieved. On the other hand, the orbiting scroll 22 of the scroll-type vacuum pump 20 is driven by the crank 30 to revolve but not self-revolving due to the restriction of the anti-self-revolving mechanism 43; such revolving motion is to form an orbiting motion, by which the orbiting scroll 22 is to rotate clockwise, thus air that is introduced in the air-introducing space 42 via conduit 41 from the outlet 17 is to be compressed, and then air compressed is to be discharged through the central outlet hole 23 in the housing 40 mounted at the center of the fixed scroll 21.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A dry vacuum pump, comprising:

a) a housing including an inlet, an outlet, a right end plate, and a left end plate;

b) a rotary-vane vacuum pump including a rotor, a pair of vanes and a stator chamber, the rotary-vane vacuum pump being mounted in the housing, with the left end plate being positioned at a left side of the rotary vane vacuum pump;

c) a scroll-type vacuum pump including a fixed scroll and an orbiting scroll, the scroll-type vacuum pump being mounted in said housing;

d) a ball-type anti-self-revolving mechanism mounted between the right end plate and the orbiting scroll of the scroll-type vacuum pump;

e) a motor-driven crank for driving the orbiting scroll of the scroll-type vacuum pump and the rotor of the rotary-vane vacuum pump; and f) wherein the rotary-vane vacuum pump is mounted on a side of the inlet, the scroll-type vacuum pump is mounted on a side of the outlet, thus forming a conduit connecting both the rotary-vane vacuum pump and the scroll-type vacuum pump for discharging and exhausting air, and air is introduced from said rotary-vane pump and discharged to an air-introducing space of the scroll-type vacuum pump and thereafter exhausted by the scroll-type vacuum pump.

2. The dry vacuum pump of claim 1, wherein the rotor includes a groove means and the pair of vanes are mounted in the groove means.

3. The dry vacuum pump of claim 1, wherein the pair of vanes are made of graphite.

4. The dry vacuum pump of claim 1, wherein the interior of the stator chamber includes a round-shaped rotating space and the rotor is eccentrically positioned within the rotating space.

5. The dry vacuum pump of claim 1, further including a spring for urging the pair of vanes into contact with a wall of the stator chamber.

6. The dry vacuum pump of claim 1, further including a valve for opening and closing the outlet of the housing.

* * * * *